US006997672B2

(12) United States Patent
Wand et al.

(10) Patent No.: US 6,997,672 B2
(45) Date of Patent: Feb. 14, 2006

(54) TURBOCHARGER

(75) Inventors: Norbert Wand, Friedrichshafen (DE); Michael Hartmann, Friedrichshafen (DE); Michael Groddeck, Meckenbeuren (DE); Wolfgang Bauer, Frankenthal (DE)

(73) Assignees: MTU Friedrichshafen GmbH, Friedrichshafen (DE); Wendt SIT GmbH, Frankenthal (DE)

( * ) Notice: Subject to any disclaimer, the term of this patent is extended or adjusted under 35 U.S.C. 154(b) by 91 days.

(21) Appl. No.: 10/430,388

(22) Filed: May 7, 2003

(65) Prior Publication Data

US 2004/0018102 A1 Jan. 29, 2004

(30) Foreign Application Priority Data

May 8, 2002 (DE) ..... 102 20 573

(51) Int. Cl.
*F01D 21/00* (2006.01)

(52) U.S. Cl. ..... 415/1; 415/9; 417/407

(58) Field of Classification Search ..... 415/9, 415/1, 119, 197, 196, 128, 212 A, 241 R; 416/2, 241 R; 417/407
See application file for complete search history.

(56) References Cited

U.S. PATENT DOCUMENTS

| | | | | |
|---|---|---|---|---|
| 4,122,673 | A * | 10/1978 | Leins | 60/274 |
| 4,875,837 | A * | 10/1989 | Usami et al. | 417/407 |
| 4,934,899 | A * | 6/1990 | Patacca | 415/9 |
| 5,662,457 | A * | 9/1997 | Bechtel et al. | 415/135 |

FOREIGN PATENT DOCUMENTS

| | | |
|---|---|---|
| DE | 3631130 A1 | 3/1987 |
| DE | 19640654 A1 | 4/1998 |
| DE | 10028160 A1 | 12/2001 |
| WO | WO 97/48943 | 12/1997 |

* cited by examiner

*Primary Examiner*—Christopher Verdier
(74) *Attorney, Agent, or Firm*—Crowell & Moring LLP

(57) ABSTRACT

A burst protector for a turbocharger covers a first endangered segment of the housing. The burst protector includes insulation, a first sheet, and a second sheet. As a supplement, a casing is installed around the burst protector. The safety of a turbocharger in operation is increased by the invention.

11 Claims, 1 Drawing Sheet

TURBOCHARGER

This application claims the priority of German application 102 20 573.6, filed May 8, 2002, the disclosure of which is expressly incorporated by reference herein.

BACKGROUND AND SUMMARY OF THE INVENTION

The present invention concerns a turbocharger for an internal combustion engine including a housing and a turbine arranged inside the housing.

Turbochargers are used to increase performance in internal combustion motors or engines. Operating ranges with high rotational speed levels and high temperatures of a turbocharger are especially critical. Parts of a defective turbine blade, for example, can penetrate a housing due to high kinetic energy.

Insulation for a turbocharger is known from PCT international publication WO 97/48943. This insulation consists of two halves that can be completely arranged around the turbocharger. They can be removed for maintenance work. In addition to contact protection, the insulation should guarantee an even temperature distribution and diminish heat tension in the casting of the housing. The casing, nonetheless, offers no secure protection against cracks in the housing.

One object of this invention is to improve the safety of a turbocharger.

This object is achieved through a burst protector that covers a first segment of the housing. Refinements are specified in the dependent claims.

The invention provides a burst protector for the turbocharger that covers a first segment of the housing. The first segment is determined by the main energy direction of the burst turbine. Here, the burst protector is non-detachably connected with the housing, for example, by micro-spot welding. The burst protector, in turn, includes insulation, a first metal sheet, and a second metal sheet. According to the invention, a turbocharger for an internal combustion engine can be protected against bursting by arranging a turbine of the turbocharger inside a housing of the turbocharger, covering a first segment of the housing with a burst protector arranged positively on an exterior of the housing, and arranging a casing around the burst protector.

The burst protector can absorb the energy of a burst turbocharger completely by way of the fixed connection between the burst protector and the housing. The kinetic energy is transformed by the two sheets into deformation energy so that collateral damage can effectively prevented. Since the burst protector is arranged only in a first segment, without additional mountings, the increase in weight is minor.

The burst protector is surrounded by a casing protecting against the environment that covers a second segment of the housing. The casing has an insulation blanket and a surrounding metal foil that is non-detachably connected with the housing. Additional burst protection is guaranteed by the casing.

A preferred design is represented in the drawings figures.

DETAILED DESCRIPTION OF THE INVENTION

Figure 1:
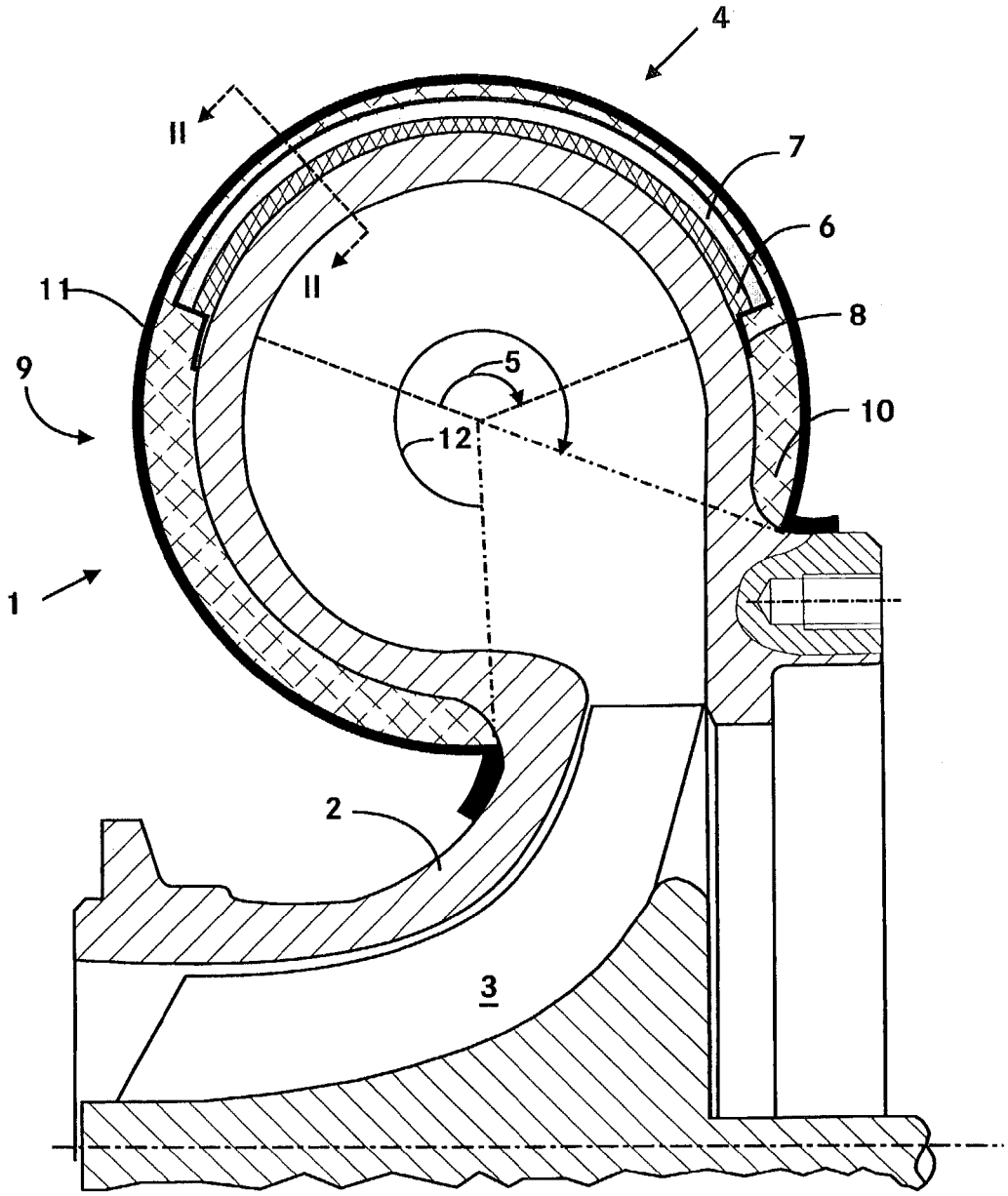
FIG. 1 shows a cross section of the housing.

A cross section of a turbocharger 1 is partially represented in FIG. 1. This includes a housing 2 with a turbine 3. The general construction and the mode of function of the turbocharger are presupposed as known. The housing 2 is provided with a burst protector 4 on the exterior in a first segment 5. The angle range defined by the first segment 5 corresponds to the main energy direction of the burst turbine 3. The burst protector 4 is formed by insulation 6, a first sheet 7, and a second sheet 8. The insulation 6 is cemented on the housing 2. In practice, the latter is formed of glass fiber and may have a thickness of 3 mm. The first sheet 7 is arranged on the insulation 6. The first sheet 7 is heat-resistant and can, for example, have a thickness of 2 mm. The insulation 6 and the first sheet 7 are surrounded by a second sheet 8. This is non-detachably connected with housing 2, for example by spot welding.

The burst protector 4 and the housing 2 are surrounded by a casing 9 in a second segment 12. The casing and the housing may be non-detachably connected with each other. The casing 9 includes an insulation blanket 10 and a metal foil 11. The insulation blanket 10 is loosely positioned on the housing 2 so as to be detachably connected with the housing and the burst protector. The insulation blanket 10 may have a thickness of 7 mm. The surrounding metal foil 11 is non-detachably connected with the housing 2. The metal foil 11 may have a thickness of 0.1 mm and can be embodied as temperature-resistant steel foil.

Figure 2:
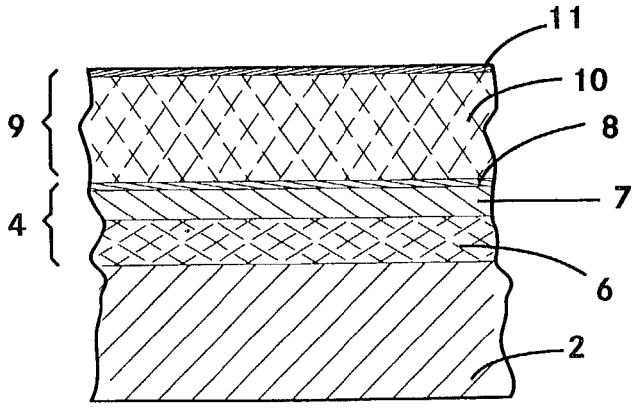
FIG. 2 is a view of a section of the housing.

FIG. 2 represents a sectional view along line II—II of FIG. 1. The construction of the burst protector 4 and the casing 9 is once again apparent. The burst protector is formed, as represented, of the insulation 6, the first sheet 7 and the second sheet 8. The casing 9 connects in a radial direction to the burst protector 4, and includes the insulation blanket 10 and the metal foil 11.

Advantages attained through the invention include:

1. The burst protector 4 is non-detachably connected with the housing 2 through which the burst energy of the turbocharger 1 is absorbed.
2. Collateral damage, for example on the internal combustion motor or a test stand, is effectively prevented.
3. Since the burst protector 4 covers only an endangered segment 5 of the housing 1, the increased weight is minor.
4. Supplemental safe burst protection is guaranteed by the casing 9.
5. Installation expenditure is minor.

The foregoing disclosure has been set forth merely to illustrate the invention and is not intended to be limiting. Since modifications of the disclosed embodiment incorporating the spirit and substance of the invention may occur to persons skilled in the art, the invention should be construed to include everything within the scope of the appended claims and equivalents thereof.

We claim:

1. A turbocharger for an internal combustion engine comprising:

a housing, a turbine arranged inside the housing, a burst protector arranged positively on an exterior of the housing and covering a first segment of the housing, and a casing arranged around the burst protector, wherein the burst protector and the housing are non-detachably connected with each other, wherein the burst protector includes insulation, a first sheet, and a second sheet, and wherein the insulation is cemented onto the housing.

2. The turbocharger according to claim 1, wherein the casing covers a second segment of the housing.

3. The turbocharger according to claim 1, wherein the casing and the housing are non-detachably connected with each other.

4. The turbocharger according to claim 3, wherein the casing includes an insulation and a metal foil.

5. The turbocharger according to claim 4, wherein the insulation blanket is detachably connected with the housing and the burst protector.

6. A turbocharger for an internal combustion engine comprising:

a housing, a turbine arranged inside the housing, a burst protector arranged positively on an exterior of the housing and covering a first segment of the housing, and a casing arranged around the burst protector, wherein the casing covers a second segment of the housing, wherein the casing and the housing are non-detachably connected with each other, wherein the casing includes an insulation blanket and a metal foil, and wherein the insulation blanket is detachably connected with the housing and the burst protector.

7. A turbocharger for an internal combustion engine comprising:

a housing, a turbine arranged inside the housing, a burst protector arranged positively on an exterior of the housing and covering a first segment of the housing, and a casing arranged around the burst protector, wherein the first segment is determined by a main energy direction of the turbine when the turbine bursts, wherein the burst protector and the housing are non-detachably connected with each other, wherein the burst protector includes insulation, a first sheet, and a second sheet, and wherein the insulation is cemented onto the housing.

8. A turbocharger for an internal combustion engine comprising:

a housing, a turbine arranged inside the housing, a burst protector arranged positively on an exterior of the housing and covering a first segment of the housing, and a casing arranged around the burst protector, wherein the first segment is determined by a main energy direction of the turbine when the turbine bursts, wherein the casing covers a second segment of the housing, wherein the casing and the housing are non-detachably connected with each other, wherein the casing includes an insulation blanket and a metal foil, and wherein the insulation blanket is detachably connected with the housing and the burst protector.

9. A turbocharger for an internal combustion engine comprising:

a housing, a turbine arranged inside the housing, a burst protector arranged positively on an exterior of the housing and covering a first segment of the housing, and a casing arranged around the burst protector, wherein the burst protector and the housing are non-detachably connected with each other, wherein the casing covers a second segment of the housing, wherein the casing and the housing are non-detachably connected with each other, wherein the casing includes an insulation blanket and a metal foil, and wherein the insulation blanket is detachably connected with the housing and the burst protector.

10. A process by which a turbocharger for an internal combustion engine can be protected against bursting comprising:

arranging a turbine of the turbocharger inside a housing of the turbocharger, covering a first segment of the housing with a burst protector arranged positively on an exterior of the housing, and arranging a casing around the burst protector, wherein the burst protector and the housing are non-detachably connected with each other, wherein the burst protector includes insulation, a first sheet, and a second sheet, and wherein the insulation is cemented onto the housing.

11. A process by which a turbocharger for an internal combustion engine can be protected against bursting comprising:

arranging a turbine of the turbocharger inside a housing of the turbocharger, covering a first segment of the housing with a burst protector arranged positively on an exterior of the housing, and arranging a casing around the burst protector, wherein the casing covers a second segment of the housing, wherein the casing and the housing are non-detachably connected with each other, wherein the casing includes an insulation blanket and a metal foil, and wherein the insulation blanket is detachably connected with the housing and the burst protector.

* * * * *